United States Patent [19]

Rogers

[11] 4,009,818

[45] Mar. 1, 1977

[54] COMBINATION CRACKER TRAY AND WASTE CONTAINER

[76] Inventor: Jack Rogers, 6557 Costello Ave., Van Nuys, Calif. 91401

[22] Filed: Dec. 19, 1975

[21] Appl. No.: 642,673

[52] U.S. Cl. ..... 229/23 R; 248/DIG. 7; 248/309 R; 248/313; 232/43.1

[51] Int. Cl.[2] ..... B65D 13/04

[58] Field of Search ..... 248/311, DIG. 7, 313, 248/309 R, 121; 211/189; 52/241, 242; 229/23 R; 232/43.1, 45.5

[56] References Cited

UNITED STATES PATENTS

| | | | |
|---|---|---|---|
| 933,883 | 9/1909 | Bryant | 232/43.1 X |
| 947,785 | 2/1910 | Bjork et al. | 232/43.1 |
| 2,532,289 | 12/1950 | Cahill | 232/43.1 X |
| 2,870,983 | 1/1959 | Booth | 248/311 R X |
| 3,477,679 | 11/1969 | Lovitz | 248/311 R X |
| 3,502,292 | 3/1970 | Yoder | 211/189 X |

*Primary Examiner*—Davis T. Moorhead
*Attorney, Agent, or Firm*—Jackson & Jones Law Corporation

[57] ABSTRACT

The present invention is directed to a storage tray and waste container, and particularly, to a novel storage tray for holding crackers and a wrapper container mounted on the storage tray. The storage tray, or holder member, has a peripheral wall, and a central locking device for removably securing an upstanding waste container. The locking device can comprise scallop-shaped fastening ears on the surface of the tray that are capable of interlocking with peripheral detents on the bottom of the waste container. The top of the waste container further has a pair of spring-biased closure members. The closure member can be formed with a pair of integral pivot pins for pivotal connection with the waste container walls and a pair of punched slits on the surface of the closure member to receive a band spring that can bias the closure member to a closed position.

Another embodiment of the present invention includes a waste container that can be hooked, or attached, to the side of a storage container, such as a basket. The top of the waste container can have spring-biased closure members, while the bottom of the waste container is open with two sets of side ports. A movable bottom member has an upwardly extending hinge member for attachment to one of the side ports and a bias detent for removable insertion into the other side port to form the bottom of the waste container. A protruding support projection attached to the bottom member can extend under the basket to complete the attachment of the waste container to the side of the basket.

8 Claims, 6 Drawing Figures

FIG. 1
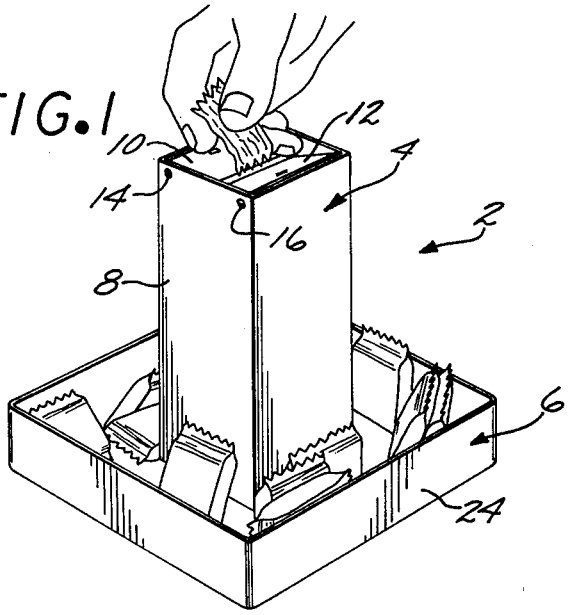
FIG. 2
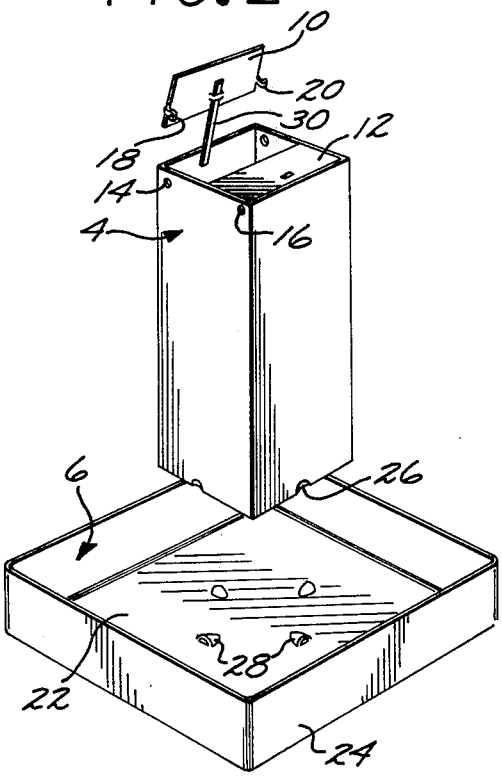
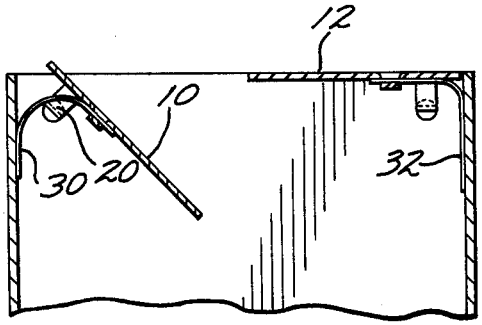
FIG. 3
FIG. 5
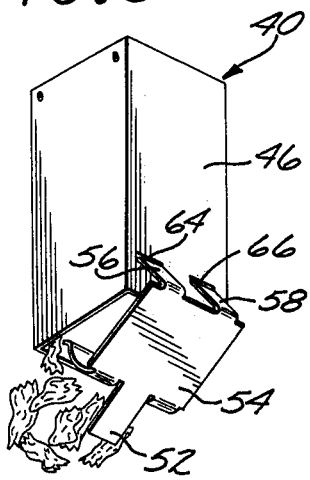
FIG. 4
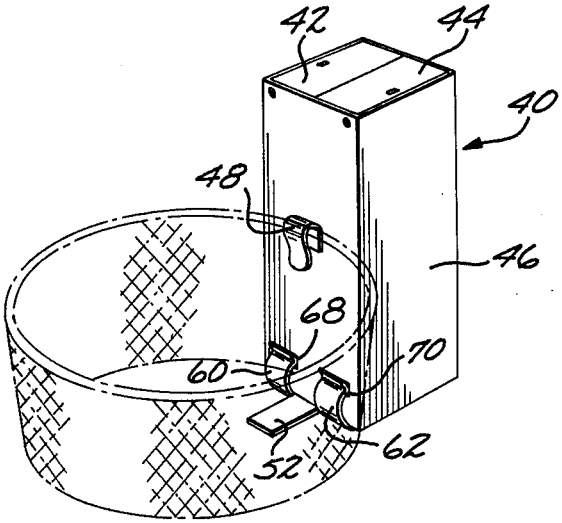
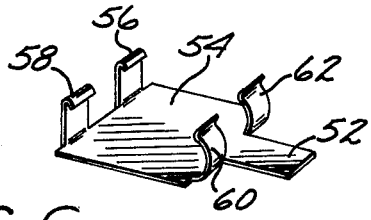
FIG. 6

COMBINATION CRACKER TRAY AND WASTE CONTAINER

BACKGROUND OF THE INVENTION

1. Field of the Invention

The present invention is directed broadly to a storage holder and a waste container, and more specifically, to a combination of a holder, or tray, for wrapped crackers and a waste container removably attached to the tray for receiving waste cracker wrappers.

2. Description of the Prior Art

There has been a growing increase in the volume of business of the prepared food serving industry in recent years, as more and more people are purchasing meals outside of the home. Frequently, soup, seafood, and appetizers require the serving of crackers. Generally, for reasons of economy and freshness, the crackers are individually wrapped. The traditional serving container has generally been a basket which is individually placed on the table. A common problem with crackers is the disposal of the wrapper. Generally, the wrappers are either placed back into the basket, which requires extra work by the restaurant help to segregate the waste wrappers from the unused crackers, or they are scattered in an undesirable fashion on the table. To date there has been no feasible solution in this problem offered in the commercial environment.

Various forms of trays are known in the patent literature, such as the following: U.S. Pat. No. 2,403,901; U.S. Pat. No. 2,946,498; U.S. Pat. No. 2,723,796; U.S. Pat. No. 3,009,623; U.S. Pat. No. 3,140,035; and U.S. Pat. No. 3,189,247.

Accordingly, there is a need to efficiently provide crackers, and the like, to the consuming public, while at the same time providing a convenient disposal container that will both efficiently and pleasantly receive the discarded wrapper.

SUMMARY OF THE INVENTION

The present invention is directed at a combination storage holder and waste container to hold various items, such as wrapped crackers and candy, for presentation to a guest, while at the same time, providing a receptacle for receiving the wrappers for convenient disposal. Basically, the storage holder will comprise a tray that removably receives the waste container. The waste container advantageously has a springbiased closure member to permit ingress of the disposed wrappers to both store and remove them from sight. Advantageously, the tray member also forms the bottom of the waste container and can include a plurality of scallop-shaped fastening ears for operatively coacting with a plurality of detents on the waste container. The closure member of the waste container can comprise a stamped, or molded, door having a pair of integral pins and a pair of slit openings for slidably receiving a band spring which will bias the door to a closed position when the pivot pins are appropriately inserted in openings on the side walls of the waste container.

In another embodiment of the present invention, a waste container is provided that can be attached to the conventional storage holder, such as a cracker basket. The waste container includes a housing with an appropriate closure member and a first securement member for attachment to the top of the cracker basket. A uniquely designed movable bottom member permits the voiding of the housing.

The features of the present invention which are believed to be novel are set forth with particularlity in the appended claims. The present invention, both as to its organization and manner of operation, together with further objects and advantages thereof, may be best understood by reference to the following description, taken in connection with the accompanying drawings.

BRIEF DESCRIPTION OF THE DRAWINGS

FIG. 1 is a perspective view of the preferred embodiment of the present invention;

FIG. 2 is an exploded perspective view of FIG. 1;

FIG. 3 is a cross-sectional view of the upper half of the waste container;

FIG. 4 is a perspective view of another embodiment of the present invention for attachment to a cracker basket;

FIG. 5 is a perspective side bottom view of the embodiment of FIG. 4 with the bottom member partially open; and FIG. 6 is a perspective view of the bottom member of the second embodiment of the invention.

DESCRIPTION OF THE PREFERRED EMBODIMENTS

The following description is provided to enable any person skilled in the food service industry to make and use the invention and sets forth the best modes contemplated by the inventor of carrying out his invention. Various modifications, however, will remain readily apparent to those skilled in the art, since the generic principles of the present invention have been defined herein specifically to provide an economical and easily manufactured combination storage holder and waste container.

Referring to the perspective view of the first embodiment of the present invention in FIG. 1, a combination storage holder and waste container apparatus 2 is disclosed. The waste container 4 is centrally located on the storage holder, or tray, 6.

The waste container 4 includes an elongated housing 8 of a rectangular shape. A pair of closure members 10 and 12 are attached to the upper portion of the elongated housing 8. Ports 14 and 16 are positioned on the elongated housing 8 to receive appropriate projections, or pivot pins, 18 and 20, on the respective closure members 10 and 12. The projections, or pivot pins, 18 and 20, can be seen more particularly in FIG. 2.

The storage holder or tray, 6 includes a lower support surface 22 and a peripheral wall, or walls, 24.

The particular components of the present invention can be formed from a metal, such as an extruded aluminum or from plastic and can advantageously have ornamental decorations, or configurations, that would be pleasing to the eye and complimentary to the particular decor, or table setting. In this regard, other configurations than that disclosed in the accompanying drawings, can obviously be utilized within the parameters of the present invention, and accordingly, the invention should not be limited to the specific geometrical body configurations shown.

The elongated housing 8 is open at its bottom, and advantageously, includes a plurality of inwardly projecting detents 26 that are designed to interlockably engage with molded, or punched, scalloped fastening ears 28 on the tray support surface 22. As can readily be appreciated, both the detents 26 and the fastening ears 28 can be reversed so that the detents would extend outward from the elongated housing side walls and the openings of the fastening ears 28 would be directed radially inward. Other forms of fastening and latching mechanisms can readily be utilized within the parameters of the invention to retain the elongated housing 8 on the tray support surface 22. As can be seen specifically in FIG. 2, the means for removably attaching the waste container member 4 to the tray, or base holder member 6, is centrally positioned to insure adequate storage area for the items, such as wrapped crackers, candy, etc.

The closure members 10 and 12 at the top of the housing 8, can comprise one or more pivoted members. In the preferred embodiment, as disclosed in the cross-sectional view of FIG. 3, a pair of closure members 10 and 12 are pivotably mounted within the elongated housing 8 and biased by respective band springs 30 and 32 to a closed position. The respective closure members 10 and 12, can be punched to provide a pair of slits for slidably receiving the band spring. The cantilevered end of the band spring would be designed to bias the respective closure member so that its end would abut against the inside of the elongated housing 8 in a closed position.

Referring to FIG. 4, another embodiment of the present invention is disclosed that is advantageously adapted to being connected with a conventional storage holder, such as a cracker basket. The waste container 40 can incorporate similar upper enclosure members 42 and 44 to that utilized in the first embodiment. The container housing 46 has an upper hook, or securement member, 48 that is designed to be readily attached over the upper edge of a basket 50. A lower securement, or projection, member 52 is mounted on a bottom member 54.

The attachment of the bottom member 54 to one side of the lower end of the container housing 46 is accomplished with a pair of hooked hinge members 56 and 58, and a pair of projecting detents 60 and 62, as can be seen in FIG. 6. The lower portion of the container housing 46 has a pair of rectangular opening 64 and 66 on the one side, and another pair of rectangular openings 68 and 70 on the other.

The upwardly extending hooked hinge members 56 and 58, are respectively inserted into the respective side rectangular openings 64 and 66, for pivotal securement. When it is desired to close the bottom of the container housing 46, the bottom member 54 is pivoted across the opening and the respective resilient projecting detents 60 and 62 are biased outwardly by the container housing surface until they match with the respective side rectangular openings 68 and 70. To empty the waste container 40, it is a simple matter to remove the waste container 40 from the basket 50 and pivot the bottom member 54 downward after releasing the projecting detents 60 and 62.

The present invention provides a relatively efficient and economic manner of solving a common problem in the food service industry, while at the same time, in at least one embodiment, of providing a storage tray for various items, cush as wrapped crackers, candy, etc.

While the preferred embodiments have been disclosed in an enabling manner to facilitate the reproduction of the present invention, it should be realized that various modifications can be easily accomplished by a persion skilled in this field, and accordingly, the present invention should be measured solely from the following claims in which I claim:

1. A combination food display storage holder and packaging waste container to hold various items, such as wrapped crackers in the storage holder and waste cracker wrappers in the waste container comprising;

a base holder member having a support surface and peripheral walls for holding food items such as crackers in a display array;

a container member having container walls extending from the support surface above the holder peripheral walls;

the container member adapted to receive and store waste wrappers, the holder member support surface cooperatively coacting with the container walls to provide the bottom structure of the container, and means on the base holder member for removably attaching the container member to the base holder, to permit the container walls to be operatively positioned adjacent the holder member support surface, the container member occupying only a portion of the base holder support surface to permit the remaining portion to form a display storage area on the base holder member between the container member walls and the holder peripheral walls for items, such as wrapped crackers.

2. The invention of claim 1 wherein the container member has a movable closure on its upper end.

3. The invention of claim 2 wherein the means for removably holding the container member includes a plurality of scallop-shaped fastening ears on the support surface and the container member has a plurality of complementarily detents for removably engaging the scalloped fastening ears.

4. The invention of claim 2 wherein the movable closure includes at least one door member with a spring biasing the door member to a closed position.

5. The invention of claim 4 wherein the door member has a pair of openings for securing a band spring to a biased position against the container member.

6. The invention of claim 1 wherein the container member has at least one spring biased closure member at one end, the opened end further including a plurality of detent members and the base holder further including a plurality of scalloped fastening ear openings for respectively interengaging with the detent members to fasten the container member to the base holder member.

7. The invention of claim 6 wherein the closure member includes a pair of integral pivot pins and a pair of punched slots, the slots receiving the spring to fasten it to the closure member.

8. In a combination cracker display container and waste receptacle for receiving cracker wrappers, the improvement comprising;

a waste receptacle housing having an upper spring biased closure member and a pair of side openings;

a first upper securement member on the side of the housing for attachment to the display container;

a second lower securement member connected to the housing for attachment to the bottom of the display container; and a bottom support member having at least one hooked hinge member for attachment to a side opening of the housing and at least one resiliently biased detent for removable insertion into the other side opening of the housing to fasten the bottom support to a closed position to receive and store cracker wrappers.

* * * * *